US006880191B2

(12) United States Patent
Bristor

(10) Patent No.: US 6,880,191 B2
(45) Date of Patent: Apr. 19, 2005

(54) SPRAY CADDY AND METHOD OF DISPENSING CHEMICALS

(76) Inventor: Joe G. Bristor, 23837 108$^{th}$ Ave. SE. #425, Kent, WA (US) 98031

( * ) Notice: Subject to any disclaimer, the term of this patent is extended or adjusted under 35 U.S.C. 154(b) by 461 days.

(21) Appl. No.: 10/032,437

(22) Filed: Dec. 31, 2001

(65) Prior Publication Data

US 2003/0150936 A1 Aug. 14, 2003

(51) Int. Cl.$^{7}$ ..... D06B 1/02

(52) U.S. Cl. ..... 8/148; 8/158; 68/5 A; 68/205 R; 134/95.3; 134/100.1; 134/103.1; 15/321

(58) Field of Search ..... 8/148, 158; 68/5 A, 68/205 R; 134/94.1, 95.1, 95.3, 98.1, 99.2, 100.1, 103.2, 172, 198; 15/302, 320, 321; 222/132, 373, 416; 137/124, 514.5, 594

(56) References Cited

U.S. PATENT DOCUMENTS

| | | | | | |
|---|---|---|---|---|---|
| 3,058,668 | A | * | 10/1962 | Harmes et al. | 239/305 |
| 3,797,744 | A | * | 3/1974 | Smith | 239/172 |
| 3,829,024 | A | * | 8/1974 | Heden | 239/310 |
| 4,103,520 | A | * | 8/1978 | Jarvis et al. | 68/12.18 |
| 4,213,796 | A | * | 7/1980 | Shaffer | 134/26 |
| 4,392,508 | A | * | 7/1983 | Switall | 137/99 |
| 4,569,483 | A | * | 2/1986 | Oberdorfer | 239/305 |
| 4,862,551 | A | * | 9/1989 | Martinez et al. | 15/321 |
| 4,949,424 | A | * | 8/1990 | Shero | 15/321 |
| 4,967,960 | A | * | 11/1990 | Futrell | 239/148 |
| 5,020,917 | A | | 6/1991 | Homan | 366/160.4 |
| 5,035,580 | A | * | 7/1991 | Simonette | 417/34 |
| 5,064,123 | A | * | 11/1991 | Aiello et al. | 239/706 |
| 5,095,579 | A | | 3/1992 | Becker | 15/339 |
| 5,261,966 | A | * | 11/1993 | Mashimo et al. | 134/2 |
| 6,206,980 | B1 | | 3/2001 | Robinson | 134/21 |
| 6,263,539 | B1 | | 7/2001 | Baig | 15/322 |
| 6,562,145 | B1 | * | 5/2003 | Duckett et al. | 134/27 |

FOREIGN PATENT DOCUMENTS

| | | | |
|---|---|---|---|
| DE | 2553880 | * | 6/1977 |
| DE | 3630555 | * | 3/1988 |

OTHER PUBLICATIONS

Jon Don Roselle ILL Mailorder Catalog.
Mechatronic Jackson Tenn. Remote Control.
Prochem Chandler Az Van Package, Holders.
IICRC Vancouver Wa Carpet Cleaning Standard.

* cited by examiner

*Primary Examiner*—Frankie L. Stinson

(57) ABSTRACT

A spray caddy (10) for storing and transporting chemicals and cleaning accessories and method of dispensing diluted liquid chemicals with improved efficiency. The spray caddy (10) comprises a container (11) and an elongate rigid tubular handle assembly (12) that extends through a first hole (32) and a second hole (34) in container (11). Hot (>180. degree. F.), pressurized water is received from a van or trailer mounted professional cleaning machine and enters the spray caddy (10) at a first end (38) of the tubular handle assembly (12) then proceeds through an integral venturi injector (58) which siphons a precisely predetermined amount of liquid concentrate from one of a plurality of predetermined liquid concentrate supply jars (76) housed safely within the interior (28) of container (11) and mixes the concentrate with the water passing through the handle assembly (12) forming a solution of precise dilution that exits a second end (70) of handle assembly (12) and is dispensed through a delivery hose (16) to a target surface (116) of the cleaning site (14). A spray caddy (10) containing sufficient variety and capacity of chemicals to complete an entire days' worth of cleaning is transported in one trip from the work vehicle to the cleaning site (14). Chemicals are applied in efficient alternating sequence in accordance with proper cleaning procedures as set forth by carpet mills and acknowledged experts in the field of carpet and upholstery cleaning.

A spray caddy (10) is provided in a completely assembled form or in a kit form comprising an assemblage of any or all of its component parts.

13 Claims, 3 Drawing Sheets

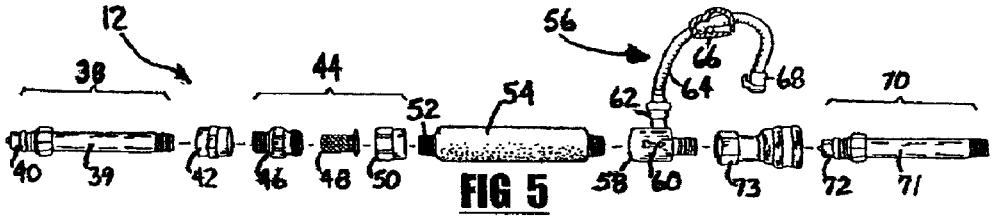
FIG 5
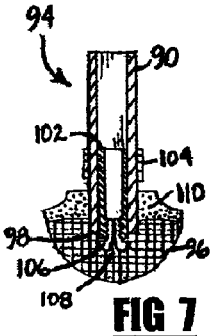
FIG 7
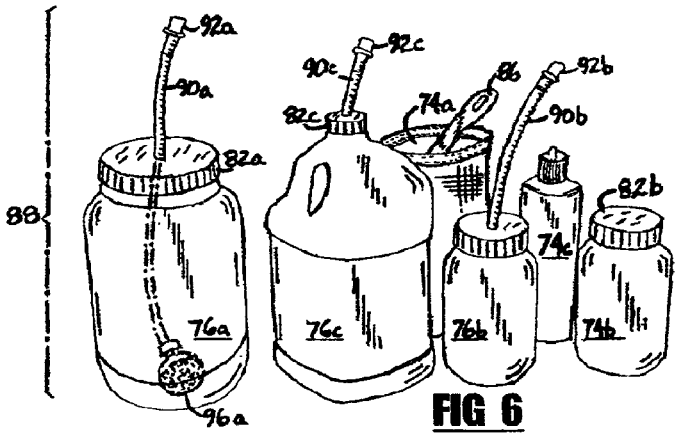
FIG 6
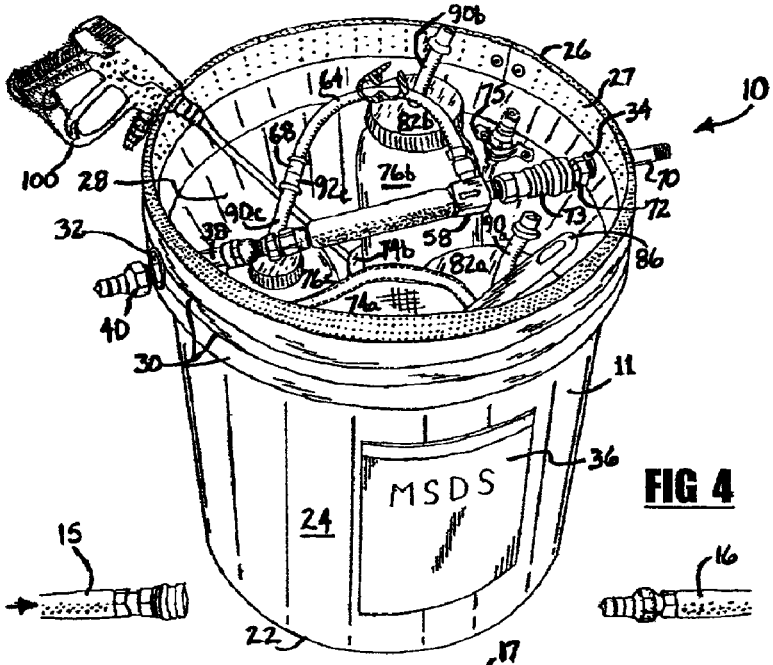
FIG 4
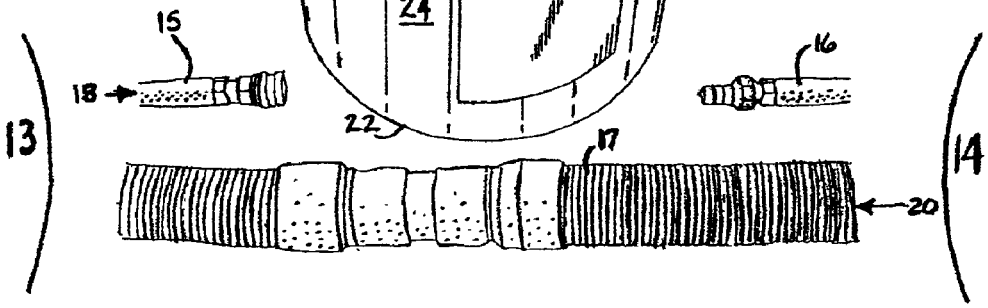

SPRAY CADDY AND METHOD OF DISPENSING CHEMICALS

BACKGROUND

1. Field of Invention

This invention relates to spraying devices, and more particularly it relates to an improved multi-chemical dispensing device and method of cleaning useful to carpet cleaners.

2. Description of Prior Art

Carpet mills have for years, recommended a method of cleaning carpet known as Hot Water Extraction ("HWE") whereby hot dilute detergent solution is topically applied to the carpet fibers then a powerful suction "extracts" the dirty water. HWE is best performed using a specialized van or trailer mounted cleaning machine or ("Machine") capable of delivering continuously hot (>180. degree. F.) and pressurized (40 to 100 pounds per square inch, psi) simultaneous with a powerful vacuum that "extracts" moisture from fibers. HWE is best described as a two step method (see prior art FIGS. 1, 2, and 3) whereby:

The first or wash step, includes a spray application of a solution of surfactants, detergents and/or enzymes generally referred to as ("prespray"). A portable spraying device (prior art FIG. 1) known as a hand-held injection sprayer 112 is commonly used for dispensing the prepsray to the target surface 116 (prior art FIG. 2). Then, the carpet fibers are agitated (typically with a hand-held carpet rake or an electric rotary buffer) to help loosen and suspend soils, and a short dwell time of 5–15 minutes is allowed to maximize chemical action. This prespray, agitate, and wait step is similar to washing clothes whereby the washing machine fills with hot soapy water (detergent) then sloshes back-and-forth "agitating" the fibers.

The second or rinse step, requires use of a specialized tool of carpet cleaners called a ("wand"). Baig, in his U.S. Pat. No. 6,263,539 (2001) refers to the wand 114 as having a tubular pipe with a vacuum head having a vacuum channel and a spray head attachment. A solution supply hose 15 and a vacuum hose 17 extending from the work vehicle 13 to the cleaning site 14 (prior art FIG. 3) provide pressurized dilute cleaning solution and suction to the wand. A mist of hot water with a rinsing agent additive (chemical known to neutralize detergents) is topically applied through the spray head of the wand to the target surface 116 simultaneous with powerful vacuum or 'extraction' strokes of the wand. The rinsing agent chemically neutralizes the prespray and the extraction strokes remove (by suction) particulate and excess moisture to a waste tank at the work vehicle. Similarly, when washing clothes, spent wash water is replaced with fresh rinse water simultaneous with a spin cycle, which "extracts" (by centrifugal force) moisture from the fibers.

Carpet cleaners repeat this two-step method job after job, using their favorite group or ("suite") of chemicals in alternating fashion; wash then rinse and sometimes a fabric protectant. Cleaners carry ample quantities of their suite of chemicals in their work vehicle.

Some systems dispense all their chemicals directly from the Machine whereby, the Machine's integral water heater, water pump, and chemical metering pump, heat and dispense hot diluted ready-to-use ("RTU") solutions of metered chemicals from one of a plurality of 5 gallon chemical concentrate containers or "5 gallon jugs" (not shown)

housed in at the Machine and delivers them through a length of solution supply hose 15 to the cleaning site 14 (prior art FIG. 2 and 3). Usually, two 5 gallon jugs are maintained; one of detergent and another of rinsing agent although, metering systems can be customized to dispense a suite of chemicals. Problems exist with systems that meter from the Machine.

Storing and transporting these 5 gallon jugs consumes the work vehicle's limited storage space and fuel; but the biggest problem with systems that meter from the Machine is the amount of time and energy expended by the operator or ("user") making repeated trips back and forth to the Machine as the job progresses switching or refilling the 5 gallon jugs, and/or to monitoring the metering pump flow rate settings as needed during the job. Further, it takes several minutes to flush the length of solution hose extending from the Machine to the cleaning site each time the switch is made (typically 100 feet or more). Attempting to save time and trips to the Machine, users adopt shortcuts like metering just one chemical (detergent) from the Machine throughout the job, skipping the rinse altogether. Detergent left in the carpet fibers leaves a sticky residue that dulls the carpet's appearance and acts like a magnet to new soil. It is like taking the clothes out of the washing machine after the wash cycle. And people who observe this method of carpet cleaning (especially women, whom know all about washing clothes), know intuitively that something is wrong with this method. It is no wonder people say "We don't want to get our carpets cleaned because it's never the same again."

To eliminate these repeated trips back to the Machine and still provide the necessary alternation of chemical, U.S. Pat. No. 5,871,152 to Saney discloses a remote controlled carpet cleaner which "offers a substantial increase in productivity by offering an operator the ability to remotely control and dispense required cleaning chemicals without making repeated trips between the cleaning site and a supply truck." These remote controlled transmitter/receiver systems have been proven successful, especially in operations like truck washes (Mechatronic Products Jackson, Tenn.) where water pressures of 3000 psi and flow rates of 3–6 (gallon per minute, gpm) can flush the solution hose in seconds, but for lower pressure operations like carpet cleaning where pressures seldom exceed 500 psi and 1 gpm, remote switching does not solve the problem of flushing the length of solution hose. Trips to switch chemical are eliminated but other trips are still needed for refilling and monitoring flow rate settings during the job. The expense of such sophisticated electronics might also be prohibitive. Cleaners often revert to portable spraying devices to avoid this flushing problem; but available portable equipment introduces another set of problems.

Pump-up sprayers and electric sprayers are portable, reliable, and capable of dispensing a wide variety of chemicals hot, but both have disadvantages. Obviously, pump-up sprayers require endless manual pumping and electric sprayers require electricity and electrical cords or batteries. Refilling of these sprayers requires trips to the work vehicle for chemicals and manual mixing of RTU solutions thus there is potential for dilution error. Both types of sprayers require that RTU solution be carried throughout the cleaning site during application, which can cause fatigue.

A recent innovation in electric sprayers employs a delivery hose with memory (like a coiled telephone cord) enabling impressive aerial coverage (up to 40 feet) and reducing the fatigue associated with carrying RTU solution throughout the cleaning site. Yet, this tubing is not known to withstand the high temperatures (>180. degree. F.) required for HWE. Also, RTU solution in pump up and electric sprayers loses temperature as the job progresses. High temperature is so critical to effective cleaning that it would make sense to discard and replace lukewarm prespray mid-job if it were not so wasteful of chemical.

Various patents disclose other portable spraying devices capable of dispensing cleaning chemicals. U.S. Pat. No. 5,020,917 to Homan et al. (1991) discloses a delivery system for mixing and metering cleaning solutions from liquid bulk concentrate storage containers into on-site individual usage dispensers. This system employs a sophisticated hydraulic and electronic design and a sturdy frame. U.S. Pat. No. 6,206,980 to Robinson (2001) discloses a multi-function cleaning machine suited for janitorial cleaning operations. U.S. Pat. No. 5,095,579 to Becker (1992) discloses a multi-use cleaning center designed for carrying groups of objects within stackable and lockable compartments safely.

These inventions provide features advantageous to fields other than the present invention's field, that is, HWE cleaning. The complexity of design and lack of portability of U.S. Pat. No. 5,020,917 to Homan et al. (1991) prohibits its application in carpet cleaning. And none of these inventions provide a way of communicating with the Machine for generating both the hot water and powerful suction necessary for achieving HWE.

Probably the most popular portable spraying device among professional carpet cleaners is the hand-held injection sprayer. It is a portable device like the pump up and electric sprayers yet it doesn't require manual pumping or use electric cords or batteries. And like the systems that meter from the Machine, the hand-held injection sprayer is capable of dispensing large volumes of continuously hot (>180. degree. F.) RTU solution without the need to carry containers of RTU solution.

The hand-held injection sprayer (prior art FIGS. 1 and 2) receives heated and pressurized water through a length of solution supply hose 15 just like the systems that meter from the Machine but chemical doesn't enter the solution hose until its distal end, where the hand-held injection sprayer is attached. Chemical is siphoned or "drawn" from a 4 or 5 quart concentrate container or ("jug") 126 by a venturi injector 58 and then dispensed through a relatively short hose 122 connecting the hand-held injector assembly and spray gun 100 to the target surface 116. Advantageously, this short hose 122 requires less time to flush relative to the time for the system that meters from the Machine. Unfortunately, the prior art hand-held injection sprayer introduces its own problems, including the fact that it is hard to use.

Carrying the hand-held injection sprayer can be tiring. Operation requires both hands; one hand to carry the rigid elongate member 124 (prior art FIG. 2) with tethered jug 126 and the other hand to control the spray gun 100. Manipulating the length of solution supply hose 15 attached to injector assembly is difficult as any measure of hose movement is hindered by the weight and bulk of liquid-filled jug. Those skilled in the art, know of these and other problems with this spraying device.

The hand-held injection sprayer is designed to draw from only one jug at a time. Numerous jugs can be filled ahead of time, but since it is unsafe to leave a group of jugs strewn about the cleaning site 14, the user must make repeated trips to the work vehicle to retrieve and switch among jugs. Having to stop and switch or refill jugs is tedious, time consuming, and ruins user concentration.

To switch jugs, a strap 128 (prior art FIG. 1) that tethers the rigid elongate member and jug must be removed before another jug may be secured. To refill jugs, the strap and jug cap 130 must be removed before more chemical concentrate can be added. Liquid concentrates are difficult to pour through the small cap opening of the jug (approximately 1½" diameter). Powdered concentrates are especially difficult to transfer into the jugs' small opening and even though powders are less bulky and more cost effective than their liquid equivalents, the difficulty in refilling the jug with powder actually discourages its use. The small cap also hinders dissolution of both powders and liquids.

Another problem with the hand-held injection sprayer has to do with changing the dilution setting. One must remove the strap (prior art FIG. 1), then unscrew the jug cap, then disassemble a tubing assembly 132, and swap-out a metering tip 106, then reassemble. Although this chore may seem to have been simplified with an improved version of the prior art hand-held injection sprayer (pat pending ? Hydro Force, 542 W. Confluence Ave. Salt Lake City, Utah, 84123) which allows the user to control the dilution ratio more directly by simply turning a handy knob protruding from the side of the venturi injector 58, still, there is chance for error as the user must monitor and readjust this knob each time chemical is switched during the job and any mistake will adversely affect the cleaning result. For example, if the label directions of a particular chemical, says to use 4 ounces per gallon, it would be easy to mistakenly set the knob to 4:1 instead of the correct setting of 32:1.

Because it is hard to switch, refill, and adjust the dilution ratio of the prior art hand-held injection sprayer, the user may resist refilling it at the beginning of each job or may need more than one full jugs' worth of concentrate to finish a job; in either case, the user has to stop and refill during the job. In an attempt to eliminate these frustrating delays, some users purchase additional hand-held injection sprayers and dedicate each to a specific chemical.

Injectors dedicated to individual chemicals tend to clog and malfunction; especially when sticky chemicals like presprays, or fabric protectants are used. The same chemical meant for alternation with presprays during HWE, namely the rinsing agent, is also the perfect chemical for keeping the injector free flowing. Maintenance is required to prevent these dedicated injectors from clogging, otherwise breakdowns occur and repair costs are incurred. Dedicating injection sprayers also increases equipment costs and creates storage problems in the work vehicle.

All of the spraying devices known in the art suffer from a number of disadvantages:

(i) They all have problems managing, transporting and dispensing a suite of chemicals.

Metering from the Machine requires multiple 5 gallon jugs to be maintained at the Machine. Several 5 gal containers could be premixed to make up a days' worth of chemical (typically enough to clean 1,000 sf), but this is impractical due to space consumed and the extra fuel needed to transport them from job to job. Flush times can be prohibitively long.

Pump up and electric sprayers can manage one or two chemicals in limited amounts (typically 1–4 gallons of RTU solution) but the chemical waste and labor associated with emptying and replacing chemicals mid-job prohibits the use of either of these devices as a multi-chemical dispensing device.

Hand-held injection sprayer can dispense large quantities of a single chemical but the tedium of managing and transporting multiple jugs renders this device impractical as a multi-chemical dispensing device.

(ii) They all present safety problems.

Chemicals metered from the Machine are often not identifiable as they enter the cleaning site. Multiple containers accumulate throughout cleaning site creating multiple potential safety hazards.

(iii) They all require trips back to work vehicle during the job.

Metering from the Machine requires trips throughout the cleaning process for switching, refilling, and monitoring chemicals. Pump up and electric sprayers require trips to retrieve and mix chemicals. Hand-held injection sprayers require trips for secondary sprayers or pre-filled jugs. All known dispensing systems keep chemical supplies at the Machine. The user spends more and more time retrieving chemicals as the total distance from Machine to cleaning site increases.

(iv) They all have problems associated with the process of switching chemicals.

Switching among chemicals during the cleaning process is an important part of HWE. Repeated cycles of alternating prespray, rinsing agent, and protectant are necessarily applied as the job progresses from area to area throughout the cleaning site.

Chemicals and sprayers end up being strewn about the cleaning site or are kept at the work vehicle necessitating trips, which wastes time and energy. Switching chemicals during the job using known spraying devices is so time consuming, that it discourages users from doing so. Some cleaners abandon proper cleaning procedures altogether, skipping the trips and simply meter large amounts of detergent through the wand. There is little or no prespray applied, no agitation or dwell time; nor is there a rinse step. The cleaning result is visually less than desired. Customers are suspicious of the process; wondering how is it possible to do both a wash and a rinse in the same step. Their suspicions are confirmed when the carpet feels sticky once dried and when the spots reappear.

(v) They all require manual dilution adjustments during the job.

Metering from the Machine involves use of an imprecise non-calibrated knob for adjusting the amount of chemical dispensed.

Pump up and electric sprayers require manual measuring and mixing of chemicals with water thus there is potential for incorrect dilutions.

The prior art hand-held injector requires a dilution setting adjustment each time a different chemical is used. The old style requires changing of a small plastic metering tip, inside a tube, and further inside the jug. The new style has a handy adjusting knob built into the venturi injector itself; but if set incorrectly, over or under application will occur which may adversely effect cleaning results.

(vi) They all have problems associated with refilling their chemical supply containers, especially mid-job.

While metering from the Machine, 5 gallon jugs can empty or the metering pump can clog or malfunction with no indication to the user. Refilling these jugs and re-priming the metering pump requires a trip to the Machine.

Refilling pump up sprayers requires bleeding off of hard-earned pressure and electric sprayers often need re-priming after refilling. Regarding prior art hand-held injection sprayers, many cleaners would rather purchase a second one and keep it ready at the work vehicle rather than go through the arduous task of refilling the jug mid-job.

(vii) They are all tiring.

The user quickly tires from the endless trips to the work vehicle when metering chemical from the Machine. On jobs with a lot of furniture to be moved, trip times and flush times could easily take longer than the actual time spent cleaning. Pump up and electric sprayers wear the user down with endless manual pumping or electric cords. Having to carry volumes of RTU solution throughout the cleaning site is also exhausting. The prior art hand-held injector jug can get heavy and hinder solution hose control. The device is especially awkward when trying to maneuver in tight places, behind doors, and under draperies.

(viii) They all have storage related problems.

All the spraying devices known in the art take up excessive amounts of space in the work vehicle or trailer. Special built-in holders are manufactured on some Machines to house the bulky 5 gallons jugs used to meter from the Machine. Special holders are also standard on some Machines for holding pump up sprayers, electric sprayers, and hand-held injection sprayers but none are known that hold more than one of each. Yet, many cleaners necessarily carry multiple pump up, electric, and/or hand-held injection sprayers. Storage space is used up quickly.

Objects and Advantages

This invention solves all of the above identified problems by providing a single multi-chemical dispensing device and still enables the user to perform HWE using a specialized van or trailer mounted cleaning Machine as defined by guidelines set by carpet mills, respected authorities and chemical manufacturers dedicated to the field.

Accordingly, several objects and advantages of the invention are:

(i) To provide a single spraying device, which can be used to manage, transport, and dispense an entire suite of chemicals.

(ii) to provide a spraying device which readily discloses written safety information regarding chemicals used and provides a safe place to store chemicals onsite.

(iii) to provide a single spraying device which dispenses all chemicals necessary for proper cleaning and requires no trips back to work vehicle once the spraying device is positioned onsite.

(iv) to provide a single spraying device which enables the user to easily switch among predetermined chemicals.

(v) to provide a spraying device which automatically adjusts the dilution ratio to the precise predetermined setting for the chemical selected.

(vi) to provide a spraying device which does not need refilling during a typical job (<1,000 sf).

(vii) to provide a spraying device which frees the user from manual pumping, electric cords, and/or carrying of RTU solution thus preserving user's energy.

(viii) to provide a spraying device which stores easily on any relatively flat surface in the work vehicle and remains stable without the need of any special holding racks.

A still further object of this invention is to provide a spraying device which is inexpensive and easy to manufacture which can be provided as a kit and in a variety of shapes and sizes; customizable to a variety of chemical dispensing needs. Further objects and advantages will become apparent from a consideration of the ensuing description of drawings.

SUMMARY

A new and novel spraying device and method is disclosed for storing, transporting and dispensing a plurality of chemicals with improved efficiency.

BRIEF DESCRIPTION OF THE DRAWINGS

The spraying device of the present invention may be more readily described by reference to the accompanying drawings, in which:

FIG. 4 is a perspective view of the spray caddy of the present invention ready in its relative position to cleaning machine, solution supply hose, solution delivery hose, and vacuum hose.

FIG. 5 is a partially exploded view of the handle assembly of the spray caddy.

FIG. 6 is a perspective view of inner containers of the spray caddy

FIG. 7 is a cross-sectional view of a metering tip assembly that fits on the base end of each supply tube

Figure 1:
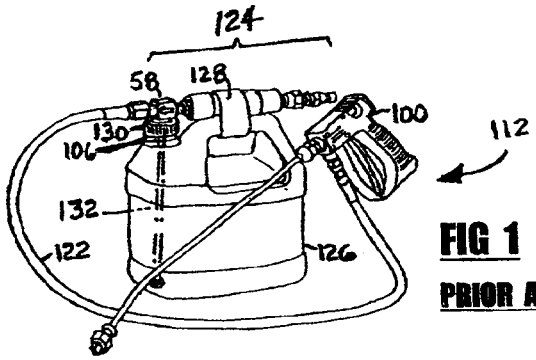
FIG 1 PRIOR ART
FIG. 1 is a perspective view of prior art hand-held injection sprayer.
Figure 2:
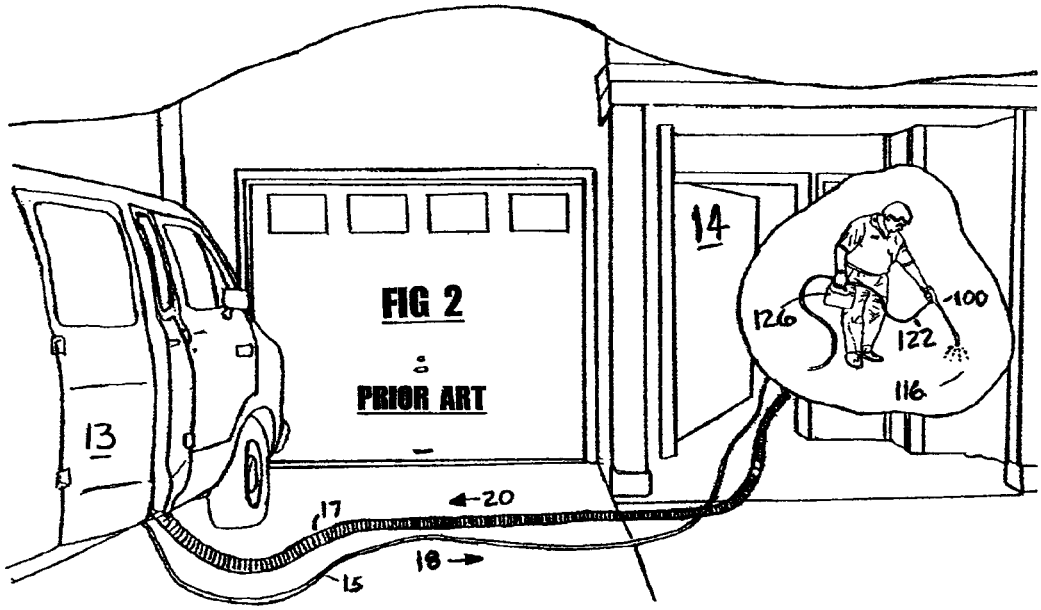
FIG 2 PRIOR ART
FIG. 2 is a view of user at cleaning site applying chemical with spray gun to target surface, whereby chemical is dispensed using prior art hand-held injection sprayer.
Figure 3:
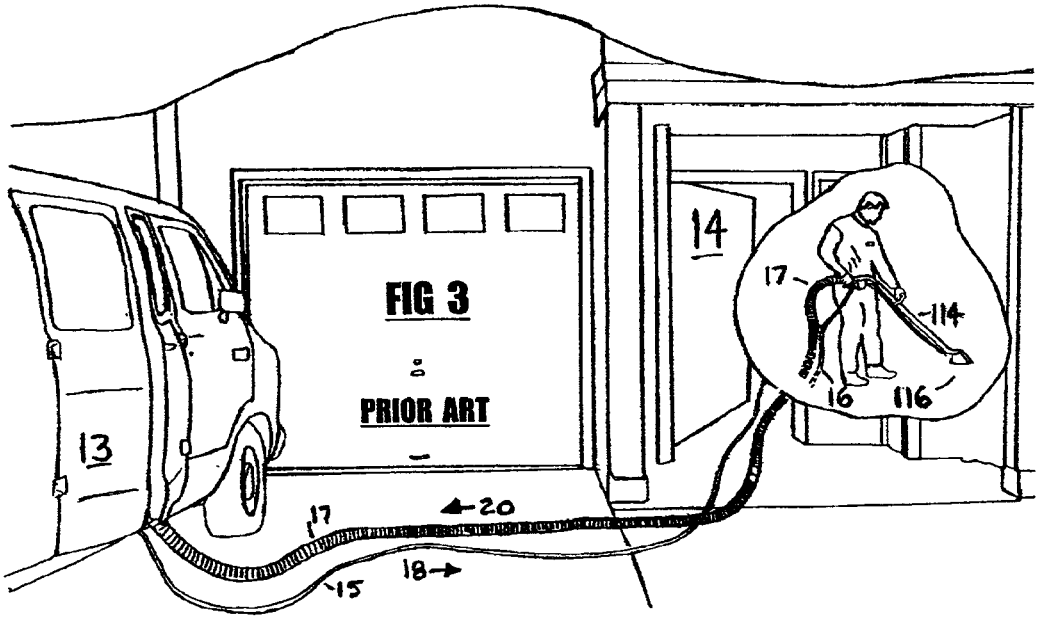
FIG 3 PRIOR ART
FIG. 3 is a view of user at cleaning site 'wanding,' whereby prior art system of metering chemical from the Machine is used for dispensing chemical to the target surface.

| REFERENCE NUMERALS IN DRAWINGS | |
|---|---|
| Spray caddy | 10 |
| Container | 11 |
| Handle assembly | 12 |
| Machine | 13 |
| Cleaning site | 14 |
| Supply hose | 15 |
| Delivery hose | 16 |
| Vacuum hose | 17 |
| Arrow-in | 18 |
| Arrow-out | 20 |
| Base | 22 |
| Sidewall | 24 |
| Rim | 26 |
| Trim | 27 |
| Interior | 28 |
| Ribs | 30 |
| First hole | 32 |
| Second hole | 34 |
| MSDS compartment | 36 |
| First end | 38 |
| First end nipple | 39 |
| First end MQD | 40 |
| Coupler | 42 |
| Strainer assembly | 44 |
| Adapter | 46 |
| Screen | 48 |
| Body | 50 |
| Handlebar | 52 |
| Handlegrip | 54 |
| Injector assembly | 56 |
| Venturi injector | 58 |
| Injector arrow | 60 |
| Check valve | 62 |
| Draw tube | 64 |
| Pinch clamp | 66 |
| Draw tube MQD | 68 |
| Second end | 70 |
| Second end MQD | 72 |
| FQD | 73 |
| Storage containers | 74a–c |
| Drybag | 74a |
| Spotter bottle | 74c |
| Holster | 75 |
| Supply jars | 76a–c |
| Manufacturers' container | 76c |
| Lid | 82 |
| Ladle | 86 |
| Supply tube assembly | 88 |
| Supply tube | 90 |
| Supply tube FQD | 92 |

-continued

| REFERENCE NUMERALS IN DRAWINGS | |
|---|---|
| Metering tip assembly | 94 |
| Strainer | 96 |
| Base end | 98 |
| Spray gun | 100 |
| Threaded insert | 102 |
| Tubing clamp | 104 |
| Metering tip | 106 |
| Orifice | 108 |
| Rubberized base | 110 |
| Hand-held injection sprayer | 112 |
| Wand | 114 |
| Target surface | 116 |
| Short hose | 122 |
| Rigid elongate member | 124 |
| Jug | 126 |
| Strap | 128 |
| Cap | 130 |
| Tubing assembly | 132 |

DETAILED DESCRIPTION

Referring more particularly to the drawings by characters of reference, FIG. 4 discloses a preferred embodiment of the spray caddy 10 used for storing, transporting and dispensing metered chemicals efficiently.

FIG. 4 shows the spray caddy 10 of the present invention comprising a container 11, handle assembly 12, and inner containers. Spray caddy 10 is also shown in its relative position to cleaning Machine 13 and cleaning site 14, supply hose 15, delivery hose 16, and vacuum hose 17.

Container 11 of FIG. 4 having the general form of a bucket comprises a base 22, sidewall 24, rim 26, trim 27, ribs 30, interior 28, first hole 32, and second hole 34. Base 22 is a horizontal surface at one end of container 11 and integral to container 11. Sidewall 24 extends from base 22 and terminates to form rim 26. Container 11, sidewall 24, and base 22 house protect and support contents placed within interior 28. Annular Rim 26 and ribs 30 bulge outward away from sidewall 24. Trim 27 is made of a grippable material like thermal plastic, which improves handling of container 11 available from T&A Supply Kent, Wash. Interior 28 is defined by base 22, sidewall 24, and rim 26. First hole 32 and second hole 34 through the sidewall 24 sight a line extending into the interior 28 that crosses the central vertical axis of the container 11. Diameter of both holes is preferably of the same diameter as the broadest diameter of MQD 40. Sidewall 24, first hole 32, and second hole 34 provide support and access for elongate rigid tubular handle assembly 12. Rim 26 and ribs 30 provide structural reinforcement for sidewall 24.

Spray caddy 10 of FIG. 4 includes various safety features including MSDS compartment 36 and cover (not shown).

MSDS compartment 36 shown in FIG. 4 is a sealable bag removably attached to sidewall 24 of container 11. MSDS compartment 36 provides an accessible and visible place to store safety information regarding the chemicals used with spray caddy 10.

Cover (not shown) is a lightweight poly shower-cap style enclosure with elastic band sewn circumference which removably fits over rim 26 of container 11 limiting access to interior 28 and inner containers. Cover may be stowed inside container 11 for ready access as needed. Suitable bucket cover is available from U.S. Plastics Lima, Ohio.

Handle assembly 12, as shown in FIGS. 4 and 5, is in the form of an elongate rigid tubular body comprising a first end 38, coupler 42, strainer assembly 44, handlebar 52 and handlegrip 54, injector assembly 56, and second end 70.

First end 38 of handle assembly 12 or "upstream end" comprises a standard pipe nipple 39 of approximately 5 inches in length with threads at both ends. One end is threadably secured to first end *MQD 40. When handle assembly 12 is in place, first end 38 typically extends beyond first hole 32 by about 2 inches and tubing portion extends through first hole 32 and into interior 28 of container 11 where it is threadably secured to coupler 42.

*QD stands for 'quick-disconnect,' referred to herein to describe the two-part mating component commonly used for releasable fluid communication of tubing or hoses. The QD notation is prefixed with M for F to indicate Male or Female mating component although mating members could be reversed if desired.

A high pressure type QD is used with handle assembly 12 and with high pressure solution hoses. Suitable high pressure quick-disconnect fittings, BH2-60, BH2-61 are available from American Hose & Fittings, Kent, Wash. Low pressure type QD is used with supply tubes 90*a–c* and draw tube 64. Suitable low pressure quick-connect fittings for tubing are available from Ryan Herco Products, Kent, Wash.

Coupler 42 is threadably secured at one end to first end 38 and other end is threadably secured to adapter 46 of strainer assembly 44. As with all the threadable connections of the handle assembly 12, standard pipe thread tape can be used during assembly to prevent leakage.

Strainer assembly 44 is a high pressure in-line particulate filter comprising an adapter 46, screen 48, and body 50 which serves to filter the water as it passes through the handle assembly 12. The screen 48 nests inside body 50. Body 50 is threadably secured to adapter 46. A suitable strainer assembly 44 is available from Spraying Systems Company Wheaton, Ill.

Handlebar 52 and handlegrip 54 form an elongate rigid tubular body with its midpoint centered over the central vertical axis of the container 11. Handlebar 52 is a standard pipe nipple of approximately 5 inches in length with standard pipe threads at both ends. One end of handlebar 52 is threadably secured to body 50 of strainer assembly 44 and the other end is threadably secured to a venturi injector 58. The handlebar 54 is encased in a similar length tubular cushioned handlegrip 56. A suitable cushioned handlegrip 56 is available from Hunte-Wilde Corp. Tampa, Fla.

Injector assembly 56, comprises a venturi injector 58 and check valve 62, both components known in the art. As pressurized water flows through the venturi injector 58 in the direction shown by the injector arrow 60, a siphoning action or "draw" is created across an orifice (not shown) in the sidewall of the venturi injector 58. Check valve 62 is fixedly secured over this orifice and extends about an inch perpendicularly away from venturi injector 58 encasing a ball bearing, ball seat, and spring (none shown) which act together to prevent pressurized fluid from escaping venturi injector 58.

Draw tube 64 is fixedly clamped to the end of check valve 62 opposite the venturi injector 58 and is of sufficient length to reach medially from check valve 62 to any point along the rim 26 of the container 11. Draw tube pinch clamp 66 slides onto draw tube 64 and can be used to stop draw through draw tube 64. Draw tube MQD 68 is fixedly secured to the end of draw tube 64 opposite the check valve 62. Suitable venturi injector 58 is model 797-3 available from DEMA Corporation, St. Louis Mo. Suitable plastic tubing, and draw tube pinch clamp 66, are available from US Plastics, Lima, Ohio.

Second end 70 of handle assembly 12 comprises a standard pipe nipple 71 of approximately 5 inches in length with a second end MQD 72 threadably secured to one end. The second end MQD 72 mates with FQD 73. When handle assembly 12 is in place, second end 70 extends beyond second hole 34 by about 2 inches. Also shown in FIG. 4, is a holster 75 used for temporarily holding second end 70 when spray caddy 10 is in use. Holster 75 is a simple 2-hole electrical conduit bracket fixedly attached to inner wall of container 11 with screw and nut. The phantom of second end 70 can be seen resting in holster 75.

The handle assembly 12 serves two useful purposes:

first, it serves to transfer pressurized fluid from the first end 38 and through the venturi injector 58 which draws chemical concentrate from one of a plurality of concentrate containers, mixing it with the water passing through handle assembly 12, then dispenses dilute RTU solution to target surface of cleaning site 14;

second, it serves as a handle for carrying the spray caddy 10 whereby handle assembly 12 itself is in the form of a horizontal elongate rigid tubular body with its cushioned handlebar 52 centered over the central vertical axis of the container 11 and with its ends protruding just beyond holes in container 11 such that an upward lifting force applied at the handlebar causes ends to contact sidewall and the spray caddy 10 is thus lifted with one hand and carried back and forth between cleaning site 14 and work vehicle.

FIG. 4 and FIG. 6 shows inner containers disposed within the interior 28 of the container 11 including storage containers 74*a–c* and supply jars 76*a–c*.

Storage containers shown in FIG. 6 are in rigid form as storage jars 74*b* and/or flexible-walled water-repellent fabric bags or drybags 74*a*. Storage jars 74*b* are preferably high density polyethylene, HDPE plastic wide-mouth jars (typical jar opening >2 inches) of variable sizes and with threadably sealable lids 82*b*. Storage jar 74*b* is used for storing liquids or powders and serves as backup to supply jars 76*a–c*. A drybag 74*a* is a collapsible pouch-type container 11 made from water repellent cloth sewn or heat sealed along its top, sides, and/or bottom. A suitable material is 400 denier nylon packcloth from Seattle Fabrics, Seattle Wash. The drybag 74*a* keeps powdered concentrates reasonably dry within the container 11 and it conforms to available space within container 11 helping to stabilize other jars. Ladle 86 allows user to dig deep into the pouch for powder. Various other storage containers can be stowed in container 11 including a spotter bottle 74*c* or spray bottle (not shown).

Supply jars shown in FIG. 6 are in rigid form, preferably HDPE plastic jars and of variable sizes with threadably sealable lids 82*a–c*. Supply jars 76*a–c* can serve as storage containers but their main purpose is to supply liquid chemical concentrates to the venturi injector 58. A one gallon jar 76*a* is ideally sized for presprays; especially when powdered presprays are ladled from drybag and dissolved with the spray gun 100. Manufacturers' chemical containers 76*c* also work well as supply jars since there is no mixing. Quart sized jars 76*b* are best for dilute chemicals like rinsing agents. Each chemical in a cleaners' suite is designated a specific supply jar and supply tube assembly 88.

Supply tube assembly 88 as shown in FIG. 6 comprises a supply tube 90*a*, lid 82*a*, supply tube FQD 92*a*, and metering tip assembly 94*a*. Each supply tube 90*a–c* extends from the base of its designated supply jar 76*a–c* and through a hole in its lid 82*a–c* to the rim 26 of container 11.

Supply tube FQD 92*a–c* are fixedly secured to supply tube 90*a–c* at the end nearest rim 26. Supply tube FQD 92*a–c* mates with the draw tube MQD 68. FIG. 4 shows supply tube 90*c* of supply jar 76*c* quick connected to draw tube 64. Other supply tubes 90*a* and 90*b* are seen ready for connection to draw tube 64.

Metering tip assembly 94 as shown in FIG. 7 comprises a threaded insert 102, a tubing clamp 104, a metering tip 106, and a strainer 96. Rigid tubular threaded insert 102 with a smooth outer wall and a threaded inner wall and with an outer diameter ("OD") to match the inner diameter ("ID") of the supply tube 90 and length typically of about 1 inch is slid into the base end 98 of supply tube 90 so that the end of the threaded insert 102 protrudes just beyond the base end 98 of the supply tube 90 by about 1/16 inch. The threaded insert 102 is fixedly clamped inside the supply tube 90 with a tubing clamp 104. The tubing clamp 104 is sized to that of the OD of the supply tube 90 and positioned over the supply tube 90 at a point where it squeezes down on the end of the threaded insert 102 furthest inside the supply tube 90 thus preventing leakage between the threaded insert 102 and supply tube 90. Draw is thus restricted to the central bore of the threaded insert 102. With the threaded insert 102 firmly in place, it is now possible to precisely set the dilution ratio using a component known in the art as a metering tip 106.

DEMA Corporation, St. Louis Mo. manufactures a metering tip kit that complements their model 797-3 injector. The kit includes several individual color-coded metering tips covering a range of precisely calibrated orifice 108 sizes. Since the size of the orifice 108 of the metering tip 106 controls the amount of chemical drawn and thus controls the dilution ratio, the user need only select the proper metering tip 106 to match the desired dilution ratio and thread it into the threaded insert 102, see FIG. 7. A strainer 96 with a chemically-resistant rubberized base 110 (one suitable strainer 96 is the #10388 from RON VIK Corp. Minneapolis, Minn.) is removably slid onto the base end 98 of supply tube 90 thus preventing particulate from clogging the orifice 108. The ID of the rubberized base 110 matches the OD of the supply tube 90. With this metering tip assembly 94, the user can precisely set the dilution ratio for the chemical designated to the supply jar 76*a–c*. The metering tip 106 can be repeatedly changed as needed by simply sliding off the strainer 96 and threading in a different metering tip 106 then replacing the strainer 96.

FIG. 4 shows a spray gun 100, one of several sprayer related accessories that can be stowed within container 11. Spray gun 100 stows with its spray tip (not shown) resting upon base 22 of container 11. A suitable spray gun 100 for carpet cleaning is model MV960 available from Ben's Cleaner Sales, Seattle, Wash. FIG. 6 shows another accessory, a spotting bottle 74*c*. Other accessories for a specific cleaning job might include spray bottles, upholstery tools, brushes, tape measure, and/or furniture tabs(none shown); all of which could be stowed in the spray caddy 10.

From a review of FIGS. 4 through 7, the assembly of spray caddy 10 from a kit will be apparent. The components that comprise each: the container 11 and its MSDS compartment, holster, trim, and cover, the handle assembly 12 and its first end 38, coupler 42, strainer assembly 44, handlebar 52 & handlegrip 54, injector assembly 56, and second end 70, and the inner containers and its plurality of storage containers 74*a–c*, supply jars 76*a–c*, supply tube assemblies 88*a–c*, metering tip assemblies 94*a–c* and various related accessories including the spray gun 100, spotting bottle 74*c*, and the means for which all these components are connected and associated can be pre-packaged together or separately into a kit. This kit includes any or all of the components necessary to assemble the spray caddy 10. The kit is arranged and compartmented so that the container, handle assembly 12, and inner containers and accessories and the components that comprise each, lay in the package ready for assembly.

Advantages

From the above description, a number of advantages of my spray caddy 10 become evident:

(i) Having a single spray caddy 10 to house all necessary chemicals and spray related accessories helps the user stay organized and conveys a sense of professionalism and organization to the customer.

(ii) User can have confidence in positioning the spray caddy 10 on cleaning site 14 because safety measures are in place. Customers appreciate knowing that all chemical safety information is in plain view within MSDS compartment along the sidewall 24 of container 11.

(iii) Having all chemicals and spray related accessories close at hand at the cleaning site 14 saves user from making any subsequent trips back to work vehicle.

(iv) One-step quick connection between draw tube 64 and desired supply tube 90 simplifies the process of switching chemicals and encourages user to alternate among chemicals as the job progresses.

(v) One-time setup of supply tube assembly 88 for each chemical in user's suite obviates dilution adjustments during the job thus eliminating any chance of dilution error.

(vi) User stocks a days' worth* of chemicals ahead of schedule, loading manufacturers' containers 76*c* or easy-fill wide-mouth supply jars 76*a* or 76*b*. Use of powdered chemicals is encouraged as drybag 74*a* and ladle 86 permit easy transfer and stirring.

(vii) Time and energy is saved by not having to pump up sprayers, manipulate electric cords, or carry RTU solution.

(viii) Spray caddy 10 is single compact unit that stores easily and is easy to locate in the work vehicle.

* Note concerning days' worth of chemicals:

Container 11 of spray caddy 10 is sized to house the entire suite of chemicals needed for a specific application. In the case of carpet cleaning, three chemicals are used over and over: prespray, rinsing agent, and protectant. The container 11 must be large enough to house these chemicals s in sufficient quantities to complete an average days' worth of cleaning (assumed to be approximately 1,000 sf).

Based on the typical recommended dilution ratios of each of the chemicals used, it can be seen that protectants are applied in a far more concentrated form than the other two chemicals:

| | |
|---|---|
| Protectants | 4:1 or more concentrated |
| Prespray | 10:1 or less concentrated |
| Rinsing agents | 320:1 or less concentrated |

The best selling protectants are formulated to cover 1000 sf per one gallon of concentrate. The spray caddy 10 thus makes room for a one gallon jug of protectant concentrate in its container 11.

Presprays are more concentrated than protectants, such that one gallon of prespray concentrate will typically provide more than enough RTU solution to clean 1,000 sf of carpet (a drybag of powdered prespray will typically make several gallons of prespray concentrate). Rinsing agents are extremely concentrated; such that smaller sized jars, say quart sized jars, hold ample concentrate to clean 1,000 sf. A standard 5 gallon bucket is of sufficient size to house the array of containers and chemicals necessary to accomplish a days' worth of carpet cleaning.

One-time Setup of the Spray Caddy 10

The spray caddy 10 is designed to house a days' worth of chemicals. All chemicals used in routine cleaning can be categorized as user's predetermined suite of chemicals. Typical suite includes: prespray, rinsing agent, and protectant. Each chemical in suite is designated a supply jar 76*a-c* and is fitted with a supply tube assembly 88 to match desired dilution ratio then stored within the interior 28 of the container 11. Storage jars 74*a–c* can also be stowed inside container 11 and used as backups. FIG. 4 shows quart supply jars stacked one atop the other, 76*b* atop 74*b*.

Custom or combination chemicals and dilutions can be setup to suit user's preference limited only by the experience and knowledge of the compatibilities of such chemicals and combinations. Examples include: dyes of various colors and dilutions, prespray+detergent, powdered prespray+liquid solvent, rinsing agent+variably scented deodorizers, etc.

To setup user's predetermined suite of chemicals:

1. Select proper supply jar 76*a–c* for each chemical based on manufacturer's recommended dilution ratio:

if label says 2 oz/gal or less, then use quart sized jar, if label says 3 oz/or more, then use gallon sized supply jar 76*a* -or- manufacturers' container 76*c*. For purposes of measuring powders, treat 'powder ounces' as though they were 'liquid ounces.'

2. Select proper metering tip 106 from kit to match desired dilution ratio. Thread metering tip 106 into base end 98 of supply tube 90, then install screen strainer 96.
3. Select proper supply tube assembly 88 (supply tube 90, lid 82, FQD 92, and strainer 96) for each supply jar 76*a–c*.
4. Fill supply jar 76*a–c* with chemical (for tan metering tip 106, add "oz chemical" then fill to top with water). Proper amount of powder is ladled from dry bag to supply jar 76*a–c* for job, then hot water is added.
5. Insert supply tube assembly 88 into supply jar 76*a–c*.

Spray Caddy Tip Selector For DEMA 797-3 Injector

| Dilution | If Label says: | Then Use: |
|---|---|---|
| 4:1 | 32 oz/gal | NO TIP |
| 5:1 | 25 oz/gal | Purple tip |
| 6:1 | 20 oz/gal | Black tip |
| 7:1 | 18 oz/gal | Yellow tip |
| 9:1 | 14 oz/gal | Blue tip |
| 10.5:1 | 12 oz/gal | Green tip |
| 13:1 | 10 oz/gal | White tip |
| 16:1 | 8 oz/gal | Red tip |
| 21:1 | 6 oz/gal | Clear tip |
| 32:1 | 4 oz/gal | Turquoise |
| 50:1 | 3 oz/gal | Orange Tip |

For the dilutions below, use Tan tip, Add chem to Quart Jar then fill to top:

| Dilution | If Label says: | Oz. Chemical |
|---|---|---|
| 66:1 | 2 oz/gal | 32 |
| 128:1 | 1 oz/gal | 16 |
| 320:1 | 2 oz/5 gal | 6.4 |
| 480:1 | 1½ oz/5 gal | 4.8 |
| 640:1 | 1 oz/5 gal | 3.2 |
| 984:1 | 2 oz/15 gal | 2.1 |
| 1280:1 | ½ oz/5 gal | 1.6 |

Position supply jars 76*a–c* and storage containers 74*a–c* inside container 11.

To better access interior 28, remove handle assembly 12 by disengaging second end MQD 72, put second end 70 in its holster 75 then simply lift handle assembly 12 up and out of container 11. Position supply jars 76*a–c* inside container 11 for ready connection between draw tube 64 and supply tubes 90*a–c*. FIG. 4 shows draw tube 64 still connected to supply tube 90*c* of protectant supply jar 76*c* from the previous job.

Operation

Stock Chemicals Daily

Supply jars 76*a–c* and storage containers 74*a–c* are replenished with days' worth of chemicals.

Inspect Job

Upon arrival to each job, user inspects job and stows any additional accessories needed inside container 11 then carries spray caddy 10 to cleaning site 14. Fully loaded, the spray caddy 10 weighs about 30 pounds. In just one trip, all chemicals and spray related accessories are onsite.

Setup Hoses

Solution hose setup includes the user extending standard 50 ft lengths of high-pressure solution hose the type used in carpet cleaning from its connection at the Machine 13 to the furthest point in the cleaning site 14.

Lengths of solution hose are typically connected end-to-end with high pressure QDs equivalent to those described for use with the handle assembly 12.

Vacuum hose 17 setup proceeds similarly: the user extends standard 50 ft lengths of vacuum hose 17 of the type used in carpet cleaning connected end-to-end with vacuum hose couplers from its connection at the Machine 13 to the furthest point in the cleaning site 14. Vacuum hose 17 is laid parallel to the length of solution hose.

Connect Spray Caddy 10

Figure 8:
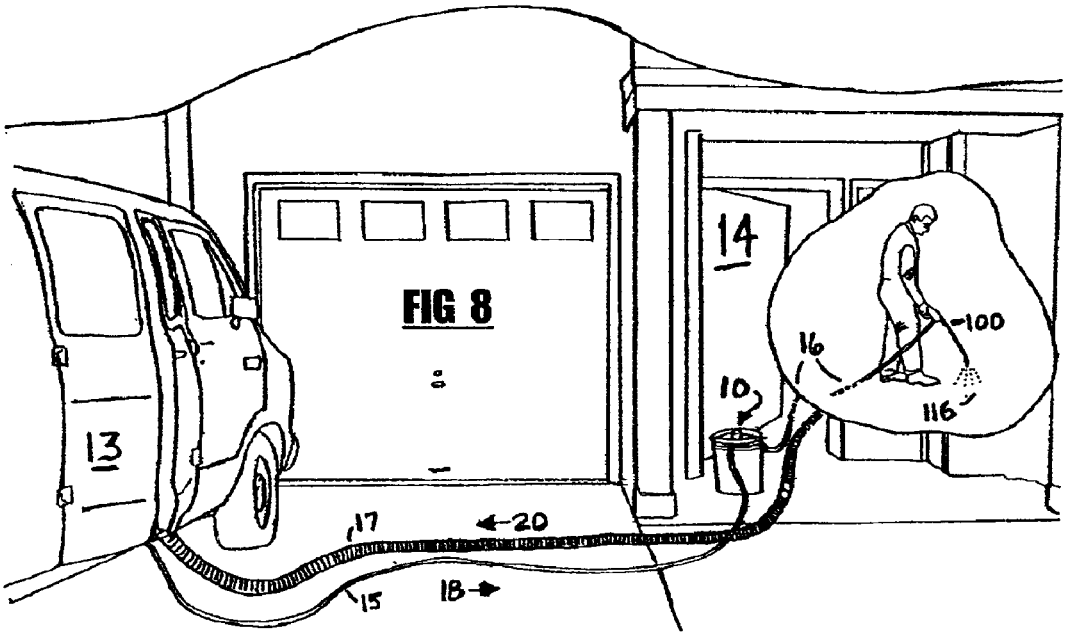
FIG. 8 is a view of user at cleaning site applying chemical with spray gun to target surface, whereby chemical is dispensed using spraying device of the present invention.
Figure 9:
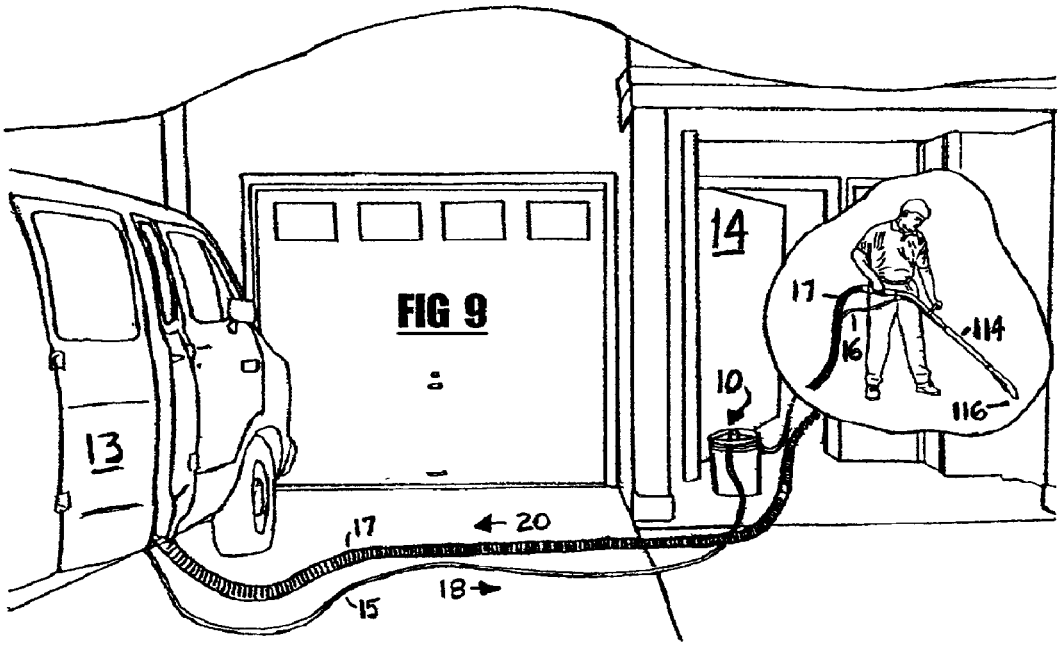
FIG. 9 is a view of user at cleaning site 'wanding,' whereby spraying device of the present invention is used for dispensing chemical to the target surface.

FIGS. 4, 8, and 9 show spray caddy 10 in its relative position to Machine 13 and cleaning site 14, supply hose 15, delivery hose 16, and vacuum hose 17.

The spray caddy 10 is preferably positioned adjacent to the solution hose QD connection furthest into the cleaning site 14 and connected there inline as follows: first, the furthest-in solution hose QD is disengaged, next, the loose end of the solution hose extending from the Machine 13 or supply hose 15 as it 'supplies' hot pressurized water from the Machine 13 is connected to spray caddy 10 at first end MQD 40, then, second end MQD 72 is disengaged from FQD 73 and second end 70 is stored in its holster 75, and the other loose end of the solution hose just disengaged becomes the delivery hose 16 as it 'delivers' hot pressurized RTU solution to the cleaning site 14, is passed through second hole 34 of container 11 and connected to FQD 73 downstream of venturi injector 58.

Connected in this way, spray caddy 10 serves as a single source multi-chemical dispensing device. A broad area can be cleaned extending circumferentially (typically 50 ft) from the stationary spray caddy 10, whereby hot pressurized water passes through supply hose 15 in the direction of the arrow-in 18 and enters the spray caddy 10 through first end 38 of handle assembly 12. Dilute chemical created at venturi injector 58, exits through downstream end of handle assembly then passes through delivery hose 16 to target surface 116 of cleaning site 14 where it is dispensed through spray gun 100 or wand 114 to target surface 116. Spent chemical, excess moisture, and particulate are extracted through the vacuum hose in the direction of the arrow-out 20 to a waste tank (not shown) housed in the work vehicle.

HWE is accomplished as follows:

Wash step: draw tube 64 is connected to supply tube 90*a* of prespray supply jar 76*a* and spray gun 100 is attached to distal end of delivery hose (see FIG. 8). Prespray is applied hot, then carpet is agitated, and a 5–15 minute chemical dwell-time is allowed. Spray caddy 10 is covered if left unattended.

Rinse step: draw tube 64 is switched to supply tube 90*b* of rinsing agent supply jar 76*b* and spray gun 100 is replaced by wand 114. Rinsing agent is applied hot and then extracted with wand 114 (see FIG. 9).

Protectant step: draw tube 64 is switched to supply tube 90*c* of protectant supply jar 76*c* and wand 114 is replaced by spray gun 100. Protectant is applied, then carpet is agitated (see FIG. 8).

The cycle is repeated, area by area throughout cleaning site 14 until job is done.

Return Equipment to Work Vehicle

Upon completion of job, supply hose 15 and delivery hose 16 are reconnected as one unit and returned to work vehicle along with vacuum hose 17. Spray gun 100, cover, and any accessories are stowed inside container 11 of spray caddy 10. Second end 70 is removed from holster 75 and reconnected to FQD 73, and the spray caddy 10 is carried back to work vehicle. Spray caddy 10 is stored as one compact unit ready for the next job where it will serve as manager, transporter, and dispenser of all chemicals needed for that job and every other job to be done that day.

Conclusion, Ramification, Scope

The spray caddy 10 has additional advantages in that:

User can take a minute to explain how the spray caddy 10 is used in the cleaning process and customer immediately understands how it helps the user work efficiently.

The chemical being dispensed is readily discernable by its supply tube 90*a–c* connection. All accessories are stored in one place—inside container 11, and covered when not attended.

However far the total distance from the work vehicle to the cleaning site 14, chemicals and spray related accessories are always close at hand (typically within 50 feet).

Confidence and morale increases as the user becomes proficient at using the spray caddy 10; realizing that switching among the necessary chemicals does help the user achieve HWE.

Not having to worry about dilution settings, frees the user to stay focused on achieving the desired result, clean rinsed carpet.

Time spent managing chemicals is reduced as compared to using other spraying devices. User realizes how 'powder friendly' the spray caddy 10 is and is encouraged to use powders thus saves money on chemicals.

Using the spray caddy 10 wastes less energy in achieving the desired result thus provides a more efficient cleaning operation than if using other spraying devices.

The spray caddy 10 is single reliable spraying device that takes up less space in the work vehicle thus other sprayers can be removed from work vehicle.

Finally, spray caddy 10 is made from readily available components. No special injection molding or electrical circuitry is needed. Assembly is easy, requiring only commonly available tools: a drill, screwdrivers, sockets, pliers, rivet tool, and wrenches.

For proper carpet cleaning, a van or trailer mounted cleaning Machine 13 is recommended because it is especially suited to deliver the hot water and powerful vacuum necessary to efficiently clean carpeting however, satisfactory cleaning results can be achieved by using spray caddy 10 in coordination with equipment other than the Machine 13. For example, sufficient heated water could be obtained from a portable boiler or a residential water heater. Electrical heaters, portable cleaning machines, or even the kitchen stove could supply hot water. And any electrical pump of approximately 50 psi or greater or even a normal garden hose pressure of 40–80 psi could deliver pressure sufficient to create draw at the orifice 108 inside venturi injector 58 and thus enable creation of dilute solution for dispensing. Sufficiently powerful vacuum could be obtained from portable cleaning machines or even wet-dry type vacuums, albeit inefficiently. This invention works with these and other combinations of heated water and vacuum generating equipment.

Spray caddy 10 could be useful anywhere there is a need for dispensing one or more chemicals and a pressurized source of fluid is available, First end 38 and second end 70 fittings could be modified to accept various types of hose fittings. For example, garden hose connectors could be fitted to the spray caddy 10 for use around the home to dispense various chemicals like car wash detergents, insecticides, and lawn foods. Any of a suite of predetermined chemicals could be dispensed, all from the same coverable container 11. Auto shops could use spray caddy 10 to dispense windshield washer detergent, antifreeze, hand cleaner and concrete garage floor cleaner. It is also conceivable that the spray caddy 10 of the present invention could be used to dispense liquids other than water-based liquids. For example, if a solvent-based rinsing agent were used, spray caddy 10 could be adapted to dispense paints, lacquers or most any other solvent-based chemical with viscosity near that of water.

Variable materials, dimensions, types, and capacities could be incorporated without affecting the spirit of the invention.

Spray caddy 10 is light enough to be carried with one hand by its handlegrip 56 although could be modified to accept wheels or could be transported by a wheeled dolly without affecting the spirit of the invention. Cover could be made of variable material and secured fixedly to spray caddy 10. Container 11 can be of various sizes and shapes including oval, square, rectangular or oblong. Container 11 is preferably made of rugged lightweight material like HDPE plastic although any thin-walled rust and chemically resistant material would suffice, Injector itself can be other than Dema's 797-3. Dema's injector is accepted by carpet cleaners and it will be easier for carpet cleaners to transition to the spraying device of the present invention. An injector with a broader range of dilution ratios is available for spray caddy 10.

This invention describes QDs as the preferred way to deliver liquid chemicals to the injector. Any of several types of tubing QDs could be used without effecting the spirit of the invention.

There are many other functional yet less advantageous ways of providing communication between chemical and injector; the simplest might be a direct tubing connection from chemical concentrate to injector. Dilution ratio adjustment could be accomplished by varying the orifice 108 size by using metering tips 106 or the orifice 108 could be situated at the injector although the preferred embodiment of the present invention anticipates this design. The present invention obviates any dilution setting adjustment for a predetermined suite of chemicals.

Multiple chemical concentrate supply tubes 90*a–c* could be brought to a junction using 2-way or multiple-way connectors that then connect to draw tube 64 which then feeds into injector; each supply tube 90 having its own pinch clamp 66 or on-off toggle. These and other systems of switching chemical, including push-button switching mechanisms could be employed that would no doubt be user friendly but would also be more expensive to implement and more likely to malfunction than the simple QD design of the present invention.

Plastic tubing can be of variable materials.

High pressure and chemically resistant tubing members of various types could be substituted for the nipples 39, 52, and 71 used in the present invention.

High pressure supply hose and delivery hose can be of variable length and pressure rating to satisfy needs of application. Supply jars 76*a–c* and storage containers 74*a–c* can be of variable sizes, or materials, Handle assembly 12 components could be of any material resistant to the temps and pressures associated with its application.

The lengths of each of the three mentioned standard pipe nipples 39, 54, and 71 can be of variable material, length or operating pressures to fit a range of container sizes and applications. The scope of this invention should be determined by the appended claims and their legal equivalents, and the descriptions provided should not be construed as limiting the scope of the invention.

I claim:

1. A spraying device for storing, transporting, and dispensing a plurality of chemicals, comprising:

a container having a base, a sidewall having a rim opposite the base and defining an interior of said container, and a first hole and a second hole in said sidewall of the container, these holes sighting a line across the central vertical axis of the container, whereby said container is used for storing a plurality of containers that contain a predetermined suite of chemical concentrates;

an elongate rigid tubular handle assembly of predetermined length comprising a plurality of members joined in series from a first end which passes through said first hole in said sidewall of said container to a second end which passes through said second hole in said sidewall of said container with a venturi injector operably connected inline between said first end and said second end of said handle assembly;

a means of extending length of said elongate rigid tubular handle assembly comprising said first end, said second end, and a handlebar, all of predetermined lengths such that when in place, said handle assembly extends roughly horizontally across said interior of said container with midpoint of said handlebar centered over central vertical axis of said container;

For purposes of transporting said spraying device, an upward lifting force applied at the midpoint of said handlebar of said handle assembly, causes said first end and said second end of said handle assembly to contact said sidewall at said first hole and said second hole respectively, effectively transferring said force to said container, whereby said spraying device is lifted for transporting;

a means of chemical supply comprises a plurality of supply jars disposed within said container, each said supply jar housing one of a predetermined said suite of chemical concentrates, each said supply jar fitted with a threadably sealable lid and a plurality of supply tube assemblies, each said supply tube slidably received thru a hole in its designated said supply jar lid, and said supply tube extending from the base of said container to said rim of said container whereby any of said supply tube assemblies may be joined by releasable fluid connection means to a draw tube extending fixedly from a check valve of said venturi injector;

a chemical draw means comprises siphoning of said chemical concentrate from said chemical supply means to said venturi injector via releasable fluid connection means between said supply tubing assembly and said draw tube;

a chemical dilution means comprises mixing of pressurized fluid flowing thru said tubular handle assembly with said chemical concentrate introduced to said venturi injector by said chemical draw means;

a dilution calibrating means comprises adjusting the size of an orifice integral to said supply tube or integral to said venturi injector;

a chemical dispensing means comprises flow of a pressurized dilute chemical solution from downstream side of said venturi injector through a length of elongate flexible delivery hose in releasable fluid connection with downstream end of said elongate rigid tubular handle assembly to a target surface, whereby said dilute chemical solution is dispensed to said target surface by fluid delivery means which comprises a spray gun or a carpet cleaner's wand.

2. The spraying device of claim 1 wherein one of the chemical concentrates contains a rinsing agent.

3. The spraying device of claim 1 wherein said releasable fluid connection means comprises a quick-disconnect coupling.

4. A method of performing hot water extraction cleaning of carpet, comprising the steps of:

a. providing a cleaning machine capable of delivering hot (>180. degree. F.) and pressurized (40 to 100 pounds per square inch) water through a solution supply hose to a cleaning site;

b. providing a cleaning machine capable of creating a vacuum through a vacuum hose to said cleaning site;

c. providing a spraying device for storing, transporting, and dispensing a plurality of chemicals;

d. providing a container having a base; a sidewall having a rim opposite the base and defining an interior of said container; and a first hole and a second hole in said sidewall of the container; these holes sighting a line across the central vertical axis of the container;

e. providing an elongate rigid tubular handle assembly of predetermined length comprising a plurality of members joined in series from a first end which passes through said first hole in said sidewall of said container to a second end which passes through second hole in said sidewall of said container with a venturi injector operably connected inline between said first end and said second end of said handle assembly;

f. providing a chemical supply means comprising a plurality of supply jars disposed within said container; each said supply jar housing one of a predetermined suite of chemical concentrates; each said supply jar fitted with a threadably sealable lid and a plurality of supply tube assemblies; each said supply tube slidably received thru a hole in its designated said supply jar lid; and said supply tube extending from the base of said container to said rim of said container whereby any of said supply tube assemblies may be joined by releasable fluid connection means to a draw tube extending fixedly from a check valve of said venturi injector;

g. providing a chemical draw means comprising siphoning of said chemical concentrate from said chemical supply means to said venturi injector via releasable fluid connection means between said supply tubing assembly and said draw tube;

h. providing a chemical dilution means comprising mixing of pressurized fluid flowing thru said tubular handle assembly with chemical concentrate introduced to said venturi injector by said chemical draw means;

i. providing a dilution calibrating means comprising adjusting the size of an orifice integral to said supply tube or integral to said venturi injector; and j. providing a chemical dispensing means comprising flow of pressurized dilute chemical solution from downstream side of said venturi injector thru a length of elongate flexible delivery hose in releasable fluid connection with downstream end of said elongate rigid tubular handle assembly to a target surface; whereby dilute chemical solution is dispensed to said target surface by fluid a delivery means which comprises a spray gun or a carper cleaner's wand.

5. The method of claim 4 wherein a days' worth of chemicals and accessories are stored by the user performing the following steps:

a. replenishing plurality of said supply jars and said storage containers with a days' worth of chemicals;

b. positioning plurality of said supply jars within said interior of said container and resting on said base of container;

c. inspecting job;

d. stowing any additional accessories needed for job inside said container; and e. carrying said container fully loaded to said cleaning site, whereby in just one trip, all chemicals and cleaning related accessories are transported to said cleaning site.

6. The method of claim 4 wherein hose setup is accomplished; by the user extending said solution supply hose and said vacuum hose from their connections at said cleaning machine to a furthest point in said cleaning site.

7. The method of claim 4 wherein said spraying device is connected inline to source of hot and pressurized water, by the user performing the following steps:

a. positioning said spraying device adjacent to the said solution hose quick disconnect fitting connection furthest into said cleaning site;

b. disengaging said furthest-in solution hose quick disconnect fitting;

c. connecting distal end of said solution hose extending from said cleaning machine to said spraying device at a first end male quick disconnect fitting;

d. disengaging a second end male quick disconnect fitting from a female quick disconnect fitting releasably connected to downstream side of said venturi injector;

e. stowing said second end in a second end holster bracket fixedly attached to said interior said sidewall of said container; and f. passing a loose end of said solution hose just disengaged through said second hole of said container and connecting to said female quick disconnect fitting; whereby connected in this way; said spraying device serves as a single source multi-chemical dispensing device enabling an area to be cleaned circumferentially about the stationary said spraying device.

8. The method of claim 4 wherein a washing step is accomplished by the user performing the following steps:

a. connecting said draw tube so a supply tube of a prespray supply jar;

b. attaching said spray gun to distal end of said delivery hose;

c. siphoning of said prespray from said prespray supply jar to said venturi injector;

d. mixing of said hot pressurized water with said prespray;

e. dispensing a diluted prespray to said target surface using said spray gun;

f. covering said spraying device when left unattended;

g. agitating carpet fibers with a carpet rake or an electric rotary buffer to help loosen and suspend soils; and h. waiting 5–15 minutes to maximize chemical action after agitating and before rinsing.

9. The method of claim 4 wherein a rinsing step is accomplished by the user performing the following steps:

a. switching said draw tube to a supply tube of a rinsing agent supply jar;

b. replacing said spray gun with said wand;

c. siphoning of said rinsing agent from said rinsing agent supply jar to said venturi injector;

d. mixing of said hot pressurized water with said rinsing agent;

e. dispensing a diluted rinsing agent to said target surface using said wand;

f. covering said spraying device when left unattended.

g. extracting spent chemical, excess moisture, and particulate through said vacuum hose from said target surface to a waste tank at said cleaning machine using the wand.

10. The method of claim 4 wherein a protecting step is accomplished by the user performing the following steps:

a. switching said draw tube to a supply tube of a fabric protectant supply jar;

b. replacing said wand with said spray gun;

c. siphoning of said fabric protectant from said fabric protectant supply jar to said venturi injector;

d. mixing of water with said fabric protectant;

e. dispensing a diluted fabric protectant to said target surface using said spray gun;

f. covering said spraying device when left unattended; and g. agitating fibers with a hand-held carpet rake to help distribute said protectant evenly.

11. The method of claim 4 wherein cleaning is concluded; by the user performing the following steps:

a. reconnecting said supply hose and said delivery hose as one unit;

b. returning reconnected said supply hose and said delivery hose along with said vacuum hose to said cleaning machine;

c. stowing said spray gun; said cover, and said accessories inside said container of said spraying device;

d. removing said second end from said second end holster bracket;

e. reconnecting said second end to said female quick disconnect fitting downstream of said venturi injector;

f. carrying said spraying device back to said cleaning machine; and g. storing said spraying device as one compact unit at said cleaning machine, whereby unit is ready to manage, transport, and dispense a said plurality of chemicals needed for every other job to be done that day.

12. A kit for retrofitting a hand-held injection sprayer having a venturi injector, the retrofit kit comprises:

a container used for storing; transporting; and dispensing a plurality of chemicals;

a plurality of supply jars disposed within said container;

a plurality of supply tube assemblies, each said supply tube slidably received thru a hole in its designated said supply jar lid; and said supply tube extending from the base of said container to said rim of said container whereby any of said supply tube assemblies may be joined by releasable fluid connection means to between a draw tube extending fixedly from a check valve of said venturi injector to any point along said rim of said container;

a chemical draw means comprises siphoning of a chemical concentrate from said supply jar from which said supply tube assembly extends and in which the said supply tube is in releasable fluid connection means with said draw tube;

a length of elongate flexible delivery hose in releasable fluid connection with downstream end of said venturi injector; and a chemical dispensing means comprises flow of pressurized dilute chemical solution from downstream side of said venturi injector thru said length of elongate flexible delivery hose to a target surface; whereby dilute chemical solution is dispensed to said target surface by fluid delivery means comprising a spray gun or a carpet cleaner's wand.

13. The kit of claim 10 wherein said releasable fluid connection means comprises a quick-disconnect coupling.

* * * * *